US008786649B2

(12) United States Patent
Gao et al.

(10) Patent No.: US 8,786,649 B2
(45) Date of Patent: Jul. 22, 2014

(54) PRINT HEAD ASSEMBLY AND PRINTER USING THE SAME

(75) Inventors: Tao Gao, Weihai (CN); Xuejun Zhang, Weihai (CN); Qiangzi Cong, Weihai (CN); Tianxin Jiang, Weihai (CN); Min Yang, Weihai (CN)

(73) Assignee: Shangdong New Beiyang Information Technology Co., Ltd., Weihai (CN)

( * ) Notice: Subject to any disclaimer, the term of this patent is extended or adjusted under 35 U.S.C. 154(b) by 0 days.

(21) Appl. No.: 13/988,342

(22) PCT Filed: Nov. 1, 2011

(86) PCT No.: PCT/CN2011/081657

§ 371 (c)(1), (2), (4) Date: May 20, 2013

(87) PCT Pub. No.: WO2012/065512

PCT Pub. Date: May 24, 2012

(65) Prior Publication Data

US 2013/0286136 A1 Oct. 31, 2013

(30) Foreign Application Priority Data

Nov. 19, 2010 (CN) ..... 2010 1 0551490

(51) Int. Cl.

*B41J 25/304* (2006.01)
*B41J 25/34* (2006.01)
*B41J 3/60* (2006.01)

(52) U.S. Cl.

CPC ..... *B41J 25/304* (2013.01); *B41J 25/34* (2013.01); *B41J 3/60* (2013.01)
USPC ..... 347/197

(58) Field of Classification Search

USPC ..... 347/197, 171, 222; 400/120.16, 82, 188
See application file for complete search history.

(56) References Cited

U.S. PATENT DOCUMENTS

| | | | | |
|---|---|---|---|---|
| 7,399,130 | B2 * | 7/2008 | Hirte et al. | 400/120.16 |
| 7,828,490 | B2 * | 11/2010 | Nihashi et al. | 400/693 |
| 7,891,893 | B2 * | 2/2011 | Sekino et al. | 400/188 |
| 2009/0268005 | A1 * | 10/2009 | Sekino et al. | 347/197 |

FOREIGN PATENT DOCUMENTS

| | | | | |
|---|---|---|---|---|
| CN | 101722741 | A | 6/2010 | |
| EP | 1872955 | A1 | 1/2008 | |
| EP | 1872957 | A2 | 1/2008 | |
| EP | 2641745 | * | 9/2013 | B41J 3/60 |
| JP | 11-20264 | * | 11/1999 | B41J 25/34 |
| WO | 2010070933 | A1 | 6/2010 | |

OTHER PUBLICATIONS

International Search Report for PCT Application No. PCT/CN2011/081657, dated Jan. 19, 2012 (8 pages).

* cited by examiner

*Primary Examiner* — Huan Tran
(74) *Attorney, Agent, or Firm* — Shumaker & Sieffert, P.A.

(57) ABSTRACT

A print head assembly and a printer using the same are disclosed. The print head assembly includes: a bracket, a print head and an elastic element. The bracket includes a first bracket body having a cavity and a lid covered on the opening of the cavity. A window is opened on the first bracket body. The print head is accommodated in the cavity of the first bracket body and hinged to the first bracket body via a first rotary shaft. The surface of a heating element of the print head is matched with the window and faces an outside paper pressing roller. The elastic element biases towards the print head so as to make the surface of the heating element of the print head have a tendency to extend outside the window. The print head assembly is capable of being detached as a whole, thus the requirements of performing single-sided printing and duplex printing in the same printer is achieved.

16 Claims, 7 Drawing Sheets

PRINT HEAD ASSEMBLY AND PRINTER USING THE SAME

This application claims priority of the Chinese invention patent application No. 201010551490.6, entitled "Print head assembly and printer using the same", filed with State Intellectual Property Office of China on Nov. 19, 2010, and all contents thereof are incorporated by reference.

TECHNICAL FIELD OF THE INVENTION

The disclosure relates to the field of printer, and in particular to a print head assembly and a printer using the same.

BACKGROUND OF THE INVENTION

The application of duplex printer which prints simultaneously on front and back sides of printing paper is becoming increasingly wider. A U.S. Pat. No. 6,784,906 discloses a duplex thermal printer, as shown in FIG. 1, which includes a first print head 150 and a first platen 170 which are supported on a first arm 130, and a second platen 180 opposite to the first print head 150 and a second print head 160 opposite to the first platen 170 which are supported on a second arm 140. Thermal paper 10 with thermal coating on both sides passes between the first print head 150 and the second platen 180, and between the second print head 160 and the first platen 170 along a paper conveying direction; the first print head 150 faces the front side 3 of the thermal paper 10 while the second print head 160 faces the back side 4 of the thermal paper 10; when both the first print head 150 and the second print head 160 generate heat under control respectively, preset images or characters are printed out on the front and back sides of the thermal paper 10.

Since the print head is an expensive component for constructing a printer, a duplex thermal printer is more expensive than a single-sided thermal printer. Therefore, on one hand, when the user, who needs single-sided printing only at present but probably needs duplex printing in the future, purchases a duplex thermal printer at the earlier stage, the initial cost of purchasing apparatus is increased and the utilization of the apparatus is not high at the earlier stage; on the other hand, when the user, who has purchased a single-sided thermal printer at the beginning, purchases a duplex thermal printer again when needing duplex printing, it not only needs to spend money on purchasing apparatus again, but also causes the wasting of apparatus because the single-sided printer already purchased is left unused.

SUMMARY OF THE INVENTION

The purpose of the disclosure is to provide a print head assembly and a printer using the same, which can easily convert a single-sided printer into a duplex printer, so as to avoid the wasting of purchasing cost and apparatus.

Therefore, the disclosure provides a print head assembly, which includes: a bracket, which is detachably connected with an outside frame, comprises a first bracket body having a cavity and a lid covered on the opening of the cavity of the first bracket body, wherein on the first bracket body a window is opened; a print head, which is accommodated in the cavity of the first bracket body and hinged to the first bracket body via a first rotary shaft, wherein the surface of a heating element of the print head is matched with the window and faces an outside paper pressing roller; and an elastic element, which biases towards the print head so as to make the surface of the heating element of the print head have a tendency to extend outside the window.

Further, the print head assembly according to the disclosure further includes a transition socket arranged on the bracket and pluggably matched with an outside plug, wherein the print head is electrically connected to corresponding pins of the transition socket.

Further, the print head assembly according to the disclosure further includes a sensor arranged on the first bracket body for detecting printing paper, wherein the sensor is electrically connected to corresponding pins of the transition socket.

Further, the lid includes a second bracket body and a third bracket body; the transition socket is arranged on a convert board, and the convert board is fixedly connected to the second bracket body; one end of the elastic element presses against the third bracket body, while the other end presses against the print head.

Further, the print head assembly according to the disclosure further includes a print head lifting mechanism, wherein the print head lifting mechanism includes a driving element arranged inside the bracket and an adjusting element driven by the driving element; the print head is fixedly connected with a press rod and the press rod pressing against the adjusting element.

Furthermore, the adjusting element is a cam, and the driving element is a motor.

Further, two ends of the first rotary shaft extend outside the first bracket body to form a locating portion for matching with the outside frame.

According to another aspect of the disclosure, a printer is provided, the printer includes: a fixed frame, which has a paper holder for accommodating printing paper; a moveable frame, which is hinged with the fixed frame and could be opened or closed relative to the fixed frame; and a first side printing mechanism and a second side printing mechanism, which are arranged along a paper passage to respectively print on the front side and back side of paper, wherein the first side printing mechanism includes a first paper pressing roller arranged on the fixed frame and a first print head assembly arranged on the moveable frame; and the second side printing mechanism includes a second print head assembly arranged on the fixed frame and a second paper pressing roller arranged on the moveable frame; wherein at least one of the first print head assembly and the second print head assembly is the print head assembly described above, which is capable of being detached as a whole.

Further, the first print head assembly is capable of being detached as a whole.

Further, the second paper pressing roller on the moveable frame is located at the outside of the first print head assembly.

Further, the second print head assembly includes a print head pivotally connected with the fixed frame through a second rotary shaft and an elastic element biasing the print head towards the second paper pressing roller.

Further, two sides of the first bracket body are provided with a locating protrusion; a locating groove clamped with the locating protrusion is arranged on the moveable frame; and a locating groove clamped with the locating protrusion is also arranged on the fixed frame.

Further, the locating protrusions are formed by shaft ends of the first rotary shaft extending outside two sides of the first bracket body.

The disclosure also provides a printer, which includes the print head assembly described above, wherein the print head assembly is arranged on a frame.

In this disclosure, a print head assembly capable of being detached as a whole is provided, thus the printer can be configured flexibly according to the requirements of users so as to avoid the wasting of purchasing cost and apparatus. For example, mounting a print head assembly capable of being detached as a whole in a single-sided printer can convert the single-sided printer into a duplex printer conveniently, or demounting a set of print head assembly from a duplex printer can convert the duplex printer into a single-sided printer conveniently. Thus, the requirement of performing single-sided printing and duplex printing in the same printer is achieved. Moreover, by arranging a transition socket on the print head assembly, the print head assembly can be connected to or detached from the printer conveniently, thus, the replacement and maintenance of the print head assembly become convenient.

Besides the purpose, characteristics and advantages described above, other purposes, characteristics and advantages of the disclosure will be described in further detail in conjunction with the attached drawings.

BRIEF DESCRIPTION OF THE DRAWINGS

Attached drawings constituting one part of the specification and used for further illustrating the disclosure are provided below to show the preferred embodiments of the disclosure and to describe the principle of the disclosure in conjunction with the specification. In the drawings.

DETAILED DESCRIPTION OF THE EMBODIMENTS

The embodiment of the disclosure is described below in further detail in conjunction with the drawings; however, the disclosure can be implemented by a plurality of different ways limited and covered by claims.

Figure 2:
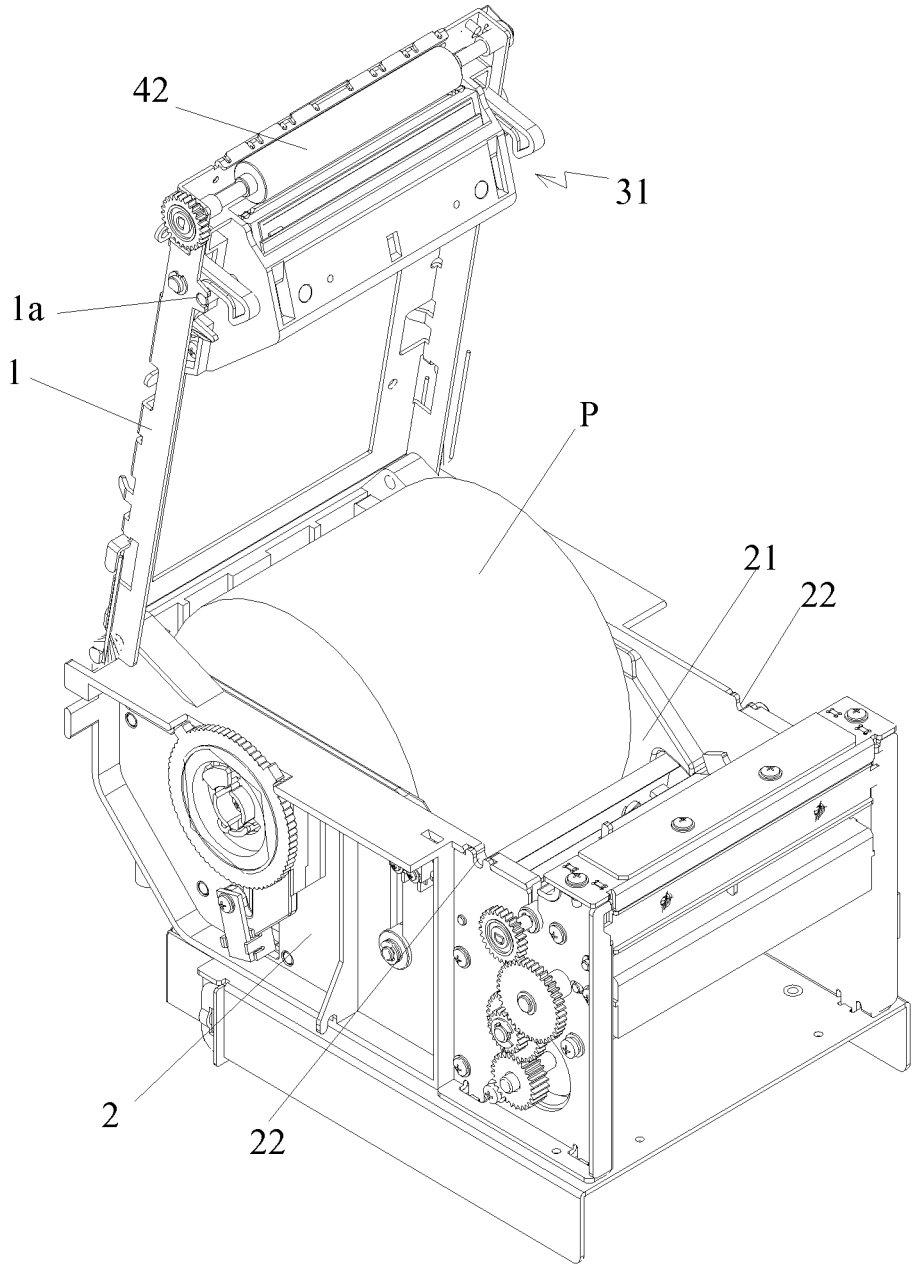
FIG. 2 shows an axonometric view of a first embodiment of a printer according to the disclosure, in which a moveable frame of the printer is opened relative to a fixed frame.
Figure 3:
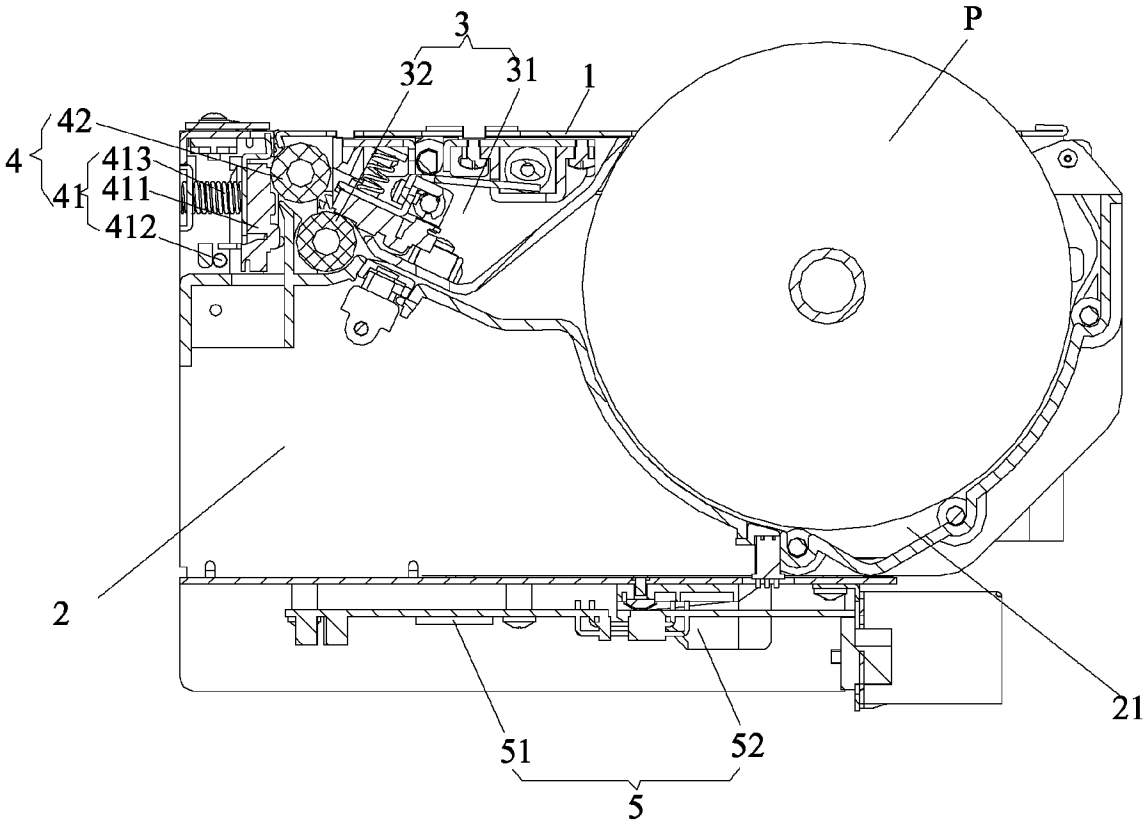
FIG. 3 shows a longitudinal sectional view of the first embodiment of the printer according to the disclosure, in which the moveable frame of the printer is closed relative to the fixed frame.

FIG. 2 shows an axonometric view of a first embodiment of a printer according to the disclosure; and FIG. 3 shows a longitudinal sectional view of the first embodiment of the printer according to the disclosure. As shown in FIG. 2 and FIG. 3, the printer includes a moveable frame 1, a fixed frame 2, a first printing mechanism 3, a second printing mechanism 4 and a control device 5.

The first printing mechanism 3 is configured to print on one side of printing paper, while the second printing mechanism 4 is configured to print on the other side of the printing paper; the control device 5 is connected with the fixed frame 2 to control the operation of the first printing mechanism 3 and the second printing mechanism 4.

The control device 5 includes a central processing unit 51 and a communication interface 52, wherein the communication interface 52 is connected with an outside control device (such as computer) to receive printing data or instruction; the central processing unit 51 controls the operation of the first printing mechanism 3 and the second printing mechanism 4 according to the received data or instruction.

The moveable frame 1 is hinged with the fixed frame 2 and could be opened or closed relative to the fixed frame 2. When the moveable frame 1 is opened relative to the fixed frame 2, a top of a paper holder 21 formed in the fixed frame 2 is opened, rolled paper P used for printing can be replaced, wherein the rolled paper P could be duplex thermal paper of which both front side and back side are provided with thermal coating, or could be single-side thermal paper of which only one side is provided with thermal coating.

The first printing mechanism 3 includes a first print head assembly 31 and a first paper pressing roller 32, wherein the first print head assembly 31 is arranged on the moveable frame 1 and the first paper pressing roller 32 is arranged on the fixed frame 2; the second printing mechanism 4 includes a second print head assembly 41 and a second paper pressing roller 42, wherein the second print head assembly 41 is arranged on the fixed frame 2 and the second paper pressing roller 42 is arranged on the moveable frame 1.

When the moveable frame 1 is closed relative to the fixed frame 2, the first print head assembly 31 and the first paper pressing roller 32 cooperate correspondingly, and the second print head assembly 41 and the second paper pressing roller 42 cooperate correspondingly.

At least one of the first print head assembly 31 and the second print head assembly 41 is the one capable of being detached as a whole, and can be detachably connected with the frame on which it is provided. In this embodiment, the first print head assembly is the print head assembly capable of being detached as a whole.

The second print head assembly 41 includes a second print head 411, a second rotary shaft 412 and a second elastic element 413. The second print head 411 is hinged with the fixed frame 2 through the second rotary shaft 412, and could rotate around the second rotary shaft 412. The second elastic element 413 is arranged between the second print head 411 and the fixed frame 2 so as to push one side of the second print head 411 provided with a heating element towards the second paper pressing roller 42 by means of some preload force. The second print head 411 is electrically connected with the control device 5 directly through a connection cable (not shown in figures).

Figure 4:
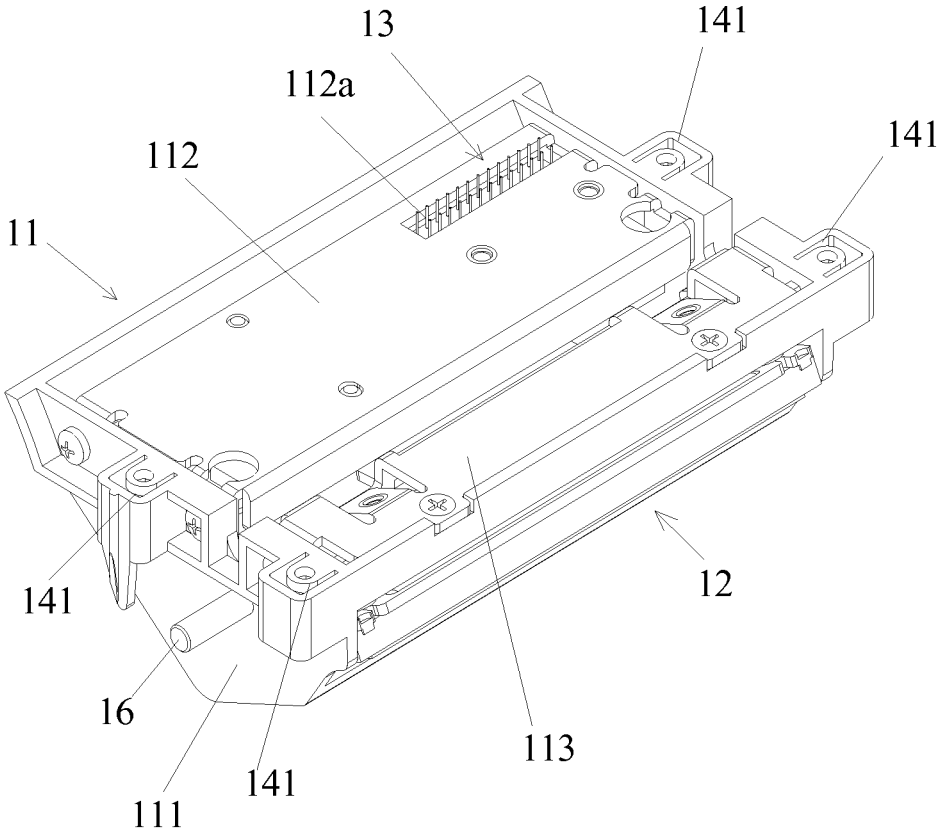
FIG. 4 shows an axonometric view of a first print head assembly according to the first embodiment of the disclosure.
Figure 5:
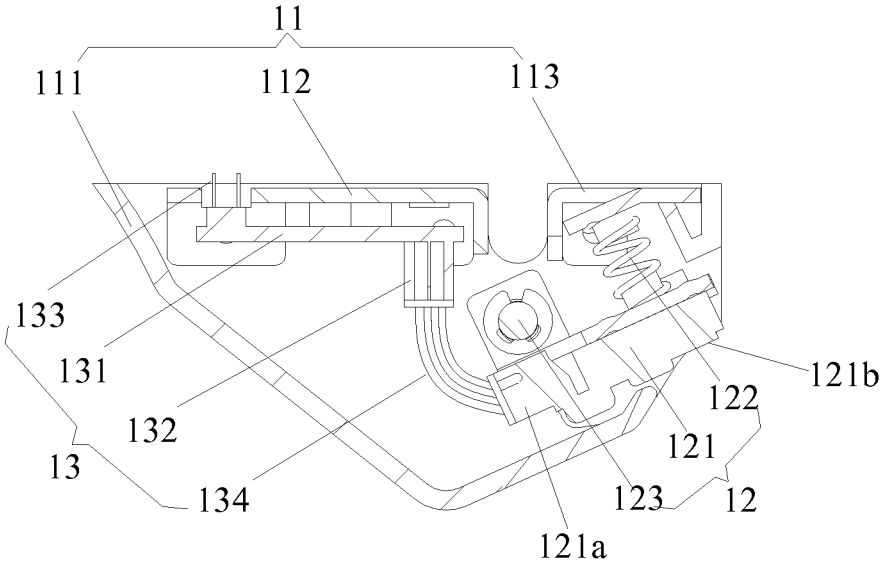
FIG. 5 shows a horizontal sectional view of the first print head assembly according to the first embodiment of the disclosure.

FIG. 4 shows an axonometric view of a first print head assembly according to the first embodiment of the disclosure; and FIG. 5 shows a horizontal sectional view of the first print head assembly according to the first embodiment of the disclosure. Hereinafter, the specific implementation of the first print head assembly is described in conjunction with FIG. 4 and FIG. 5. As shown in FIG. 4 and FIG. 5, the first print head assembly 31 includes a bracket 11, a print head module 12 and a convert component 13, wherein the print head module 12 and the convert component 13 are arranged inside the bracket 11.

The bracket 11 includes a first bracket body 111, a second bracket body 112 and a third bracket body 113, wherein the first bracket body 111 has a cavity, the opening of the cavity of the first bracket body is covered by the second bracket body 112 and the third bracket body 113 which are fixedly connected with the first bracket body 111 respectively, an internal space is formed by all three. The first bracket body 111 is provided with a mounting portion, wherein the mounting portion could be a mounting hole or a hook for connecting with the frame to which the first bracket body is attached. In this embodiment, the mounting portion could be of four mounting holes 141 arranged on four corners of the bracket 11. Preferably, the first print head assembly 31 further includes a locating portion 16 which is matched with a corresponding position on the frame to which the first print head assembly 31 is attached, so as to accurately limit the fixing position on the frame to which the bracket 11 is attached. Specifically, locating portions 16 are arranged on two sides of the first bracket body 111 vertically, and could be a shaft or a rod.

The print head module 12 includes a first print head 121, a first elastic element 122 and a first rotary shaft 123. The first print head 121 is hinged with the first bracket body 111 through the first rotary shaft 123, and could rotate around the first rotary shaft 123. One end of the first print head 121 provided with a socket 121*a* is extended into the first bracket body 111, and one end of the first print head 121 provided with a heating element 121*b* is matched with a window 111*a* arranged on the surface of the first bracket body 111 (refer to FIG. 8), so that the surface of the heating element 121*b* of the first print head 121 is exposed outside the closed space which is formed by the first bracket body 111, the second bracket body 112 and the third bracket body 113 and could be tangent with the first paper pressing roller. One end of the first elastic element 122 is located between the first print head 121 and the third bracket body 113 above the first print head 121 so as to push one side of the first printing head 121 provided with a heating element to the first paper pressing roller by means of some preload force.

Preferably, the first rotary shaft 123 and the locating portion 16 are of the same element; specifically, two ends of the first rotary shaft 123 vertically extend outside two sides of the first bracket body 111 respectively to match with a corresponding position on the frame of the printer, so as to accurately limit the fixing position of the bracket 11 on the frame of the printer. This setting mode enables the first rotary shaft to have a dual function of supporting the print head and locating the print head assembly, and reduce the number of elements.

The convert component 13 includes a convert board 131, a print head connecting socket 132, a transition socket 133 and a print head cable 134. The convert board 131 is fixedly connected with the second bracket body 112; the print head connecting socket 132 and the transition socket 133 are welded with the convert board 131; and the transition socket 133 is provided with pins which are connected with each pin of the print head connecting socket 132 correspondingly. The transition socket 133 is matched with an opening 112*a* (shown in FIG. 4) provided on the surface of the second bracket body 112, and exposes outside the closed space formed by the first bracket body 111, the second bracket body 112 and the third bracket body 113 so as to be interconnected with outside. One end of the print head cable 134 is connected with the print head socket 121*a*, while the other end thereof is connected with the print head connecting socket 132. It should be noted that the print head connecting socket 132 and the transition socket 133 might be a pin or a jack.

It should be noted that, in other embodiments of the disclosure, the convert board 131, the print head connecting socket 132 and the transition socket 133 might not be provided, and the print head cable 134 could be connected with outside through the opening on the surface of the second bracket body 112.

Figure 6:
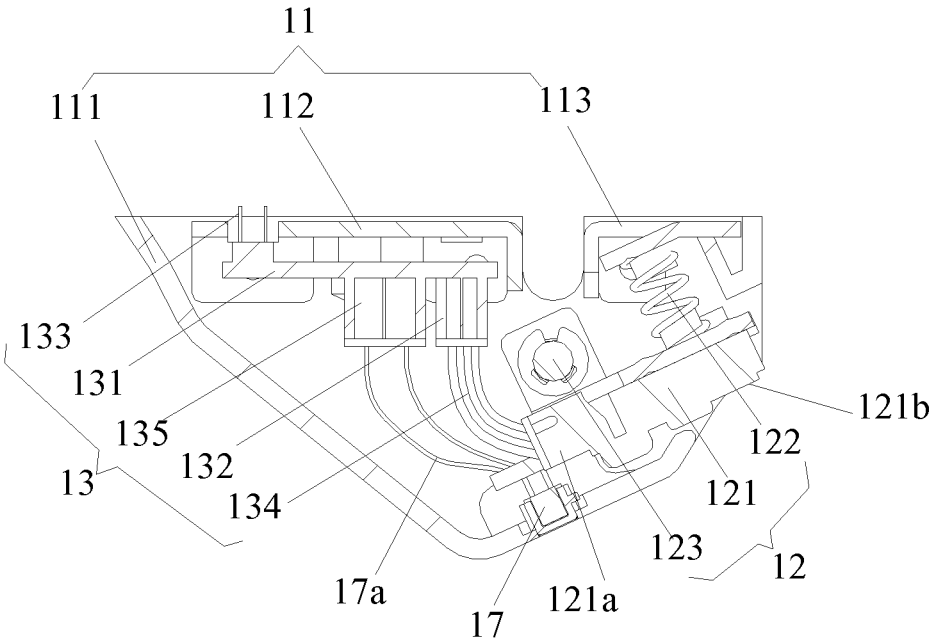
FIG. 6 shows a horizontal sectional view of the first print head assembly according to a second embodiment of the disclosure.

FIG. 6 shows a horizontal sectional view of the first print head assembly according to a second embodiment of the disclosure. The difference between this embodiment and the first embodiment lies in that: the first print head assembly further includes a sensor 17 which is configured to detect the existence state of printing paper or the mark on the surface of the printing paper. Correspondingly, the convert component 13 further includes a sensor socket 135 and a sensor cable 17*a*, wherein the sensor socket 135 is welded with the convert board 131, and the transition socket 133 is provided with pins which are connected with each pin of the sensor socket 135 correspondingly. The sensor cable 17*a* of the sensor 17 is connected with the sensor socket 135.

It should be noted that, in the condition of not providing a convert board in other embodiments of the disclosure, the sensor cable 17*a* could be connected with outside through the opening on the surface of the second bracket body 112.

Figure 7:
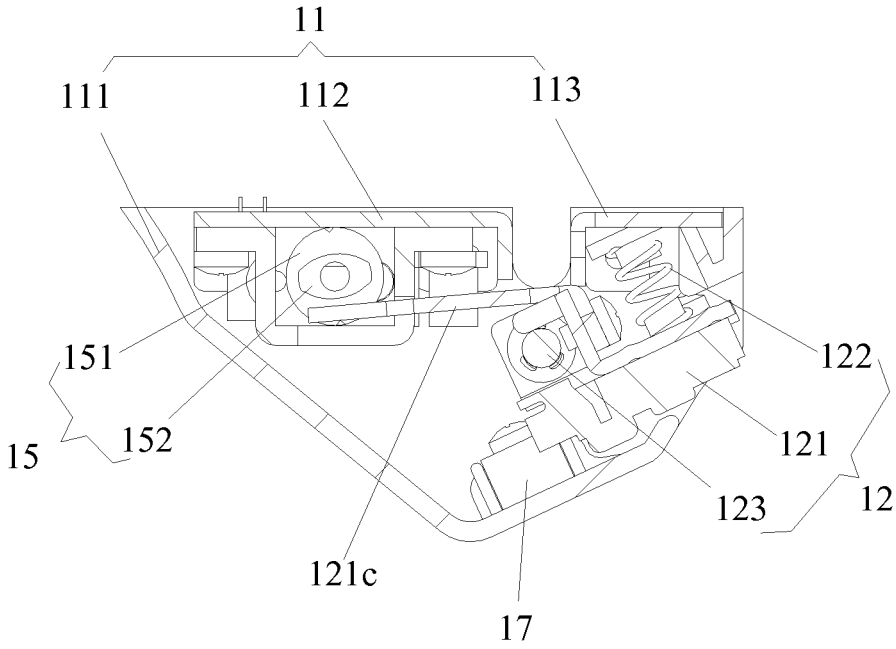
FIG. 7 shows a horizontal sectional view of the first print head assembly according to a third embodiment of the disclosure.
Figure 8:
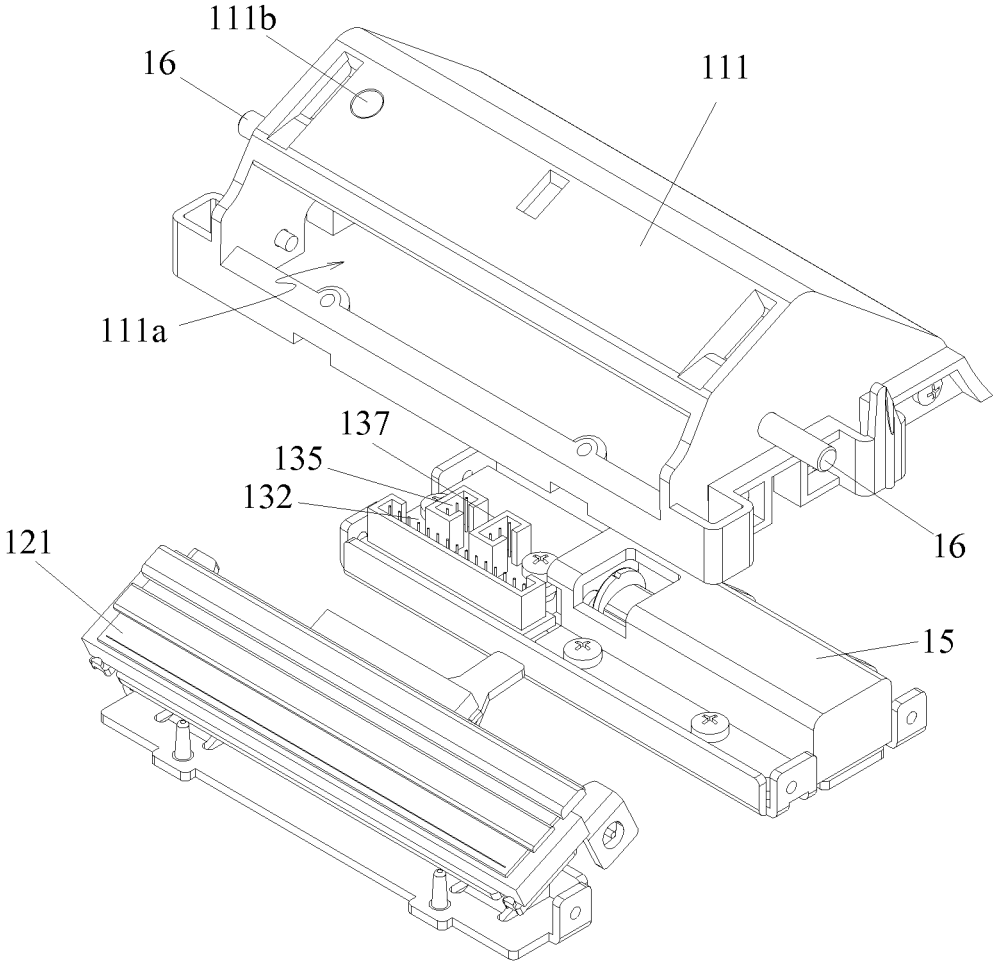
FIG. 8 shows an explosive view of the first print head assembly according to the third embodiment of the disclosure.

FIG. 7 shows a horizontal sectional view of the first print head assembly according to a third embodiment of the disclosure; and FIG. 8 shows an explosive view of the first print head assembly according to the third embodiment of the disclosure. The difference between this embodiment and the second embodiment lies in that: the first print head assembly 31 further includes a print head lifting mechanism 15 which is configured to lift or release the first print head, so that the first print head could be separated from or matched with the first paper pressing roller 32 opposite to the first print head.

The print head lifting mechanism 15 includes a driving element 151 and an adjusting element 152, wherein the driving element 151 is fixedly connected with the bracket 11; specifically, the driving element 151 could be fixedly connected with one of the first bracket body 111, the second bracket body 112 and the third bracket body 113; in this embodiment, the driving element 151 is fixedly connected with the second bracket body 112.

The adjusting element 152 is fixedly connected with a driving shaft of the driving element 151 and is connected with a brace 121*c* of the print head 121. When the driving element 151 drives the adjusting element 152 to rotate to a first position (as shown in FIG. 7), the first print head 121 is located at a working position, where the first print head 121 is pressed against the first paper pressing roller 32, under the elastic force of the first elastic element 122; when the driving element 151 drives the adjusting element 152 to rotate to a second position, the first print head 121 is located at a non-working position, where the first print head 121 is separated from the first paper pressing roller 32, by overcoming the elastic force of the first elastic element 122.

When the first print head 121 does not need to work, the driving element 151 of the print head lifting mechanism is controlled to drive the print head to rotate in the direction away from the first paper pressing roller 32, so that the print head is located at a non-working position; thus, there is no force exerted between the print head and the thermal paper so that the abrasion of the print head caused by the paper is reduced and the load for conveying paper is reduced.

It should be noted that the driving element 151 could be an electrical component, such as motor, or could be a manual spanner. The adjusting element 151 could be a cam, an eccentric wheel or a press rod; in this embodiment, the driving element 151 is a motor and the adjusting element 152 is a cam. Correspondingly, the convert component 13 further includes a motor socket 137, wherein the motor socket 137 is welded with the convert board 131; and the transition socket 133 is further provided with pins which are connected with each pin of the motor socket 137 correspondingly. The connection cable of the motor is connected with the motor socket 137.

It should be noted that the purpose of providing the convert component 13 is to intensively output pins of the connection cable of the electrical components in the first print head assembly, such as print head, sensor, motor and so on, through the transition socket 133 of the convert component 13, so that the control device 5 of the printer could be connected conveniently.

It should be noted that, in other embodiments, the second bracket body and the third bracket body can be substituted by an integrated lid.

Figure 1:
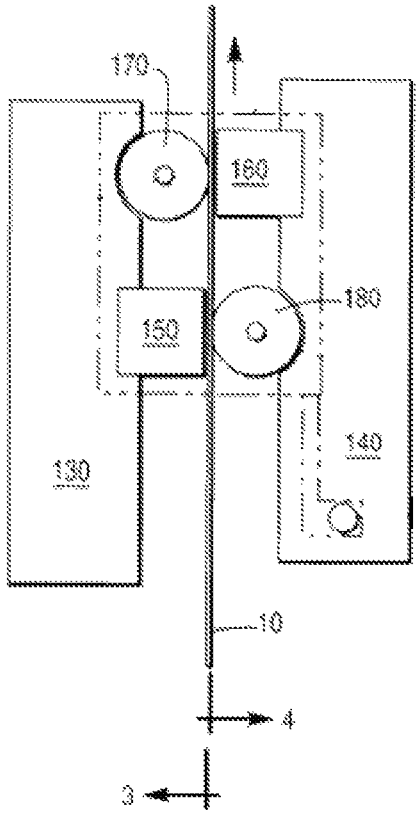
FIG. 1 shows a diagram of a conventional duplex thermal printer.
Figure 9:
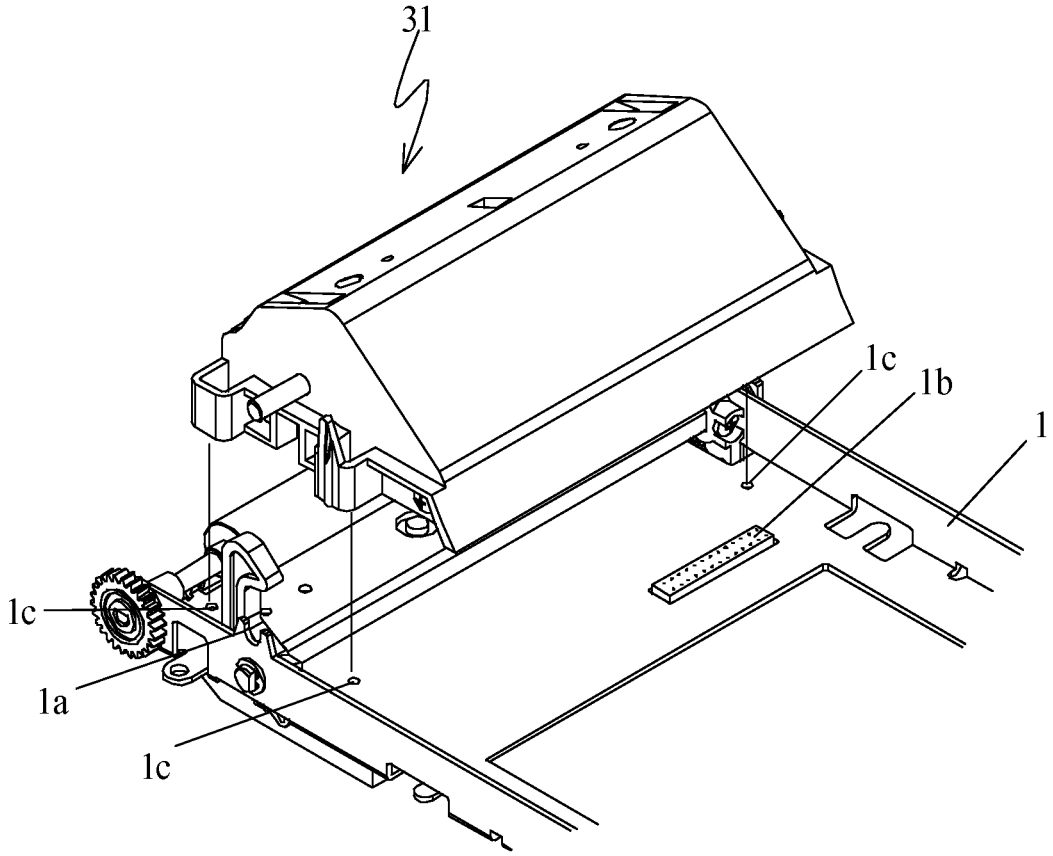
FIG. 9 shows a diagram illustrating the assembly relationship between the first print head assembly and the moveable frame according to the disclosure.

FIG. 9 shows a diagram illustrating the assembly relationship between the first print head assembly and the moveable frame according to the disclosure. Hereinafter, the connection relationship between the first print head assembly and the moveable frame will be described in conjunction with FIG. 1 and FIG. 9. As shown in FIG. 1 and FIG. 9, a connection portion 1*c* (shown in FIG. 9) matched with the mounting portion of the first print head assembly 31 is arranged on the moveable frame 1, wherein the connection portion could be a mounting hole or a clamp groove. The first print head assembly 31 is detachably connected with the connection portion of the moveable frame 21 through the mounting portion.

The moveable frame 1 is further provided with a first locating groove 1*a* corresponding to the locating portion 16 of the first print head assembly 31; when the first print head assembly 31 is mounted on the moveable frame 1, the locating portion 16 is clamped with the first locating groove 1*a*, so that the fixing position of the first print head assembly 31 on the moveable frame 1 is accurate. Correspondingly, the fixed frame 2 is also provided with a second locating groove 22 corresponding to the locating portion 16 of the first print head assembly 31; when the moveable frame 1 is closed relative to the fixed frame 2, the locating portion 16 is clamped with the second locating groove 22, so that the fitting position between the print head and the first paper pressing roller can be accurate in the first printing mechanism 3.

The moveable frame 1 is provided with an extension plug 1*b* matched with the transition socket 133 of the first print head assembly 31; after the first print head assembly 31 is fixedly connected with the moveable frame 1, the transition socket 133 is plugged with the extension plug 1*b*. The extension plug 1*b* is connected with the control device 5 through a connection cable (not shown in figures); therefore, electrical components in the first printing mechanism 31, such as first print head, sensor or motor etc, are electrically connected with the control device 5 through the extension plug 1*b*; wherein the control device 5 can control the operation of each device of the first print head assembly 31 according to requirements. Therefore, by providing an extension plug 1*b* connected with the transition socket 133 of the first print head assembly 31 in the printer, convenience of the connection between the electrical component in the first print head assembly and the control device 5 of the printer is enhanced.

In the printer according to the disclosure, by providing a connection portion and an extension plug which are matched with a detachable print head assembly (that is, the first print head assembly in the above embodiments), a single-sided printer can be converted into a duplex printer conveniently. When the user who needs single-sided printing only at present but probably needs duplex printing in the future purchases a printer, it would be unnecessary to purchase the print head assembly, that is, unnecessary to install the print head assembly; therefore, the initial cost of purchasing apparatus is not increased. When duplex printing is needed, only a detachable print head assembly is purchased and is connected with the extension plug of the printer without reinstalling the connection cable and changing the control device, thus the single-sided printer could be converted into a duplex printer. When the printing requirement of a user is changed, the printer provided by the disclosure will not increase the initial cost of purchasing apparatus and waste the apparatus purchased.

It should be noted that, in other embodiments of the disclosure, the second print head assembly also could be a print head assembly detachably connected with the fixed frame 2. When the second print head assembly is a print head assembly capable of being detached as a whole, the specific implementation thereof is the same as that of the first print head assembly 1, not tired in words here. When both the first print head assembly and the second print head assembly are a print head assembly capable of being detached as a whole, besides that the printer could be conveniently converted from a duplex printer into a single-side printer, or from a single-sided printer into a duplex printer, a user could separate the print head assembly from the frame (that is, the moveable frame and the fixed frame) of the printer easily according to requirements so as to facilitate the replacement and maintenance of the print head assembly.

The above are only the preferred embodiments of the disclosure and not intended to limit the disclosure. For those skilled in the art, various modifications and changes can be made to the disclosure. Any modification, equivalent substitute and improvement made within the spirit and principle of the disclosure are deemed to be included within the scope of protection of the disclosure.

What is claimed is:

1. A print head assembly, comprising:

a bracket, which is detachably connected with an outside frame, comprises a first bracket body having a cavity and a lid covered on the opening of the cavity of the first bracket body, wherein on the first bracket body a window is opened;

a print head, which is accommodated in the cavity of the first bracket body and hinged to the first bracket body via a first rotary shaft, wherein the surface of a heating element of the print head is matched with the window and faces an outside paper pressing roller; and an elastic element, which biases towards the print head so as to make the surface of the heating element of the print head have a tendency to extend outside the window.

2. The print head assembly according to claim 1, wherein the print head assembly further comprises a transition socket arranged on the bracket and pluggably matched with an outside plug, wherein the print head is electrically connected to corresponding pins of the transition socket.

3. The print head assembly according to claim 2, wherein the print head assembly further comprises a sensor arranged on the first bracket body for detecting printing paper, wherein the sensor is electrically connected to corresponding pins of the transition socket.

4. The print head assembly according to claim 2, wherein the lid comprises a second bracket body and a third bracket body; the transition socket is arranged on a convert board, and the convert board is fixedly connected to the second bracket body; one end of the elastic element presses against the third bracket body, while the other end presses against the print head.

5. The print head assembly according to claim 1, wherein the print head assembly further comprises a print head lifting mechanism, wherein the print head lifting mechanism comprises a driving element arranged inside the bracket and an adjusting element driven by the driving element; the print head is fixedly connected with a press rod pressing against the adjusting element.

6. The print head assembly according to claim 5, wherein the adjusting element is a cam, and the driving element is a motor.

7. A printer, comprising:

a fixed frame, which has a paper holder for accommodating printing paper;

a moveable frame, which is hinged with the fixed frame and could be opened or closed relative to the fixed frame; and a first side printing mechanism and a second side printing mechanism, which are arranged along a paper passage to respectively print on the front side and back side of paper, wherein the first side printing mechanism comprises a first paper pressing roller arranged on the fixed frame and a first print head assembly arranged on the moveable frame; and the second side printing mechanism comprises a second print head assembly arranged on the fixed frame and a second paper pressing roller arranged on the moveable frame;

wherein at least one of the first print head assembly and the second print head assembly is the print head assembly according to claim 1 capable of being detached as a whole.

8. The printer according to claim 7, wherein the first print head assembly is capable of being detached as a whole.

9. The printer according to claim 8, wherein the second print head assembly comprises a print head pivotally connected with the fixed frame through a second rotary shaft and an elastic element biasing the print head towards the second paper pressing roller.

10. The printer according to claim 8, wherein the first bracket body of the first print head assembly is provided on both sides thereof with locating protrusions; the moveable frame is provided with locating grooves matched with the locating protrusions; and the fixed frame is provided with locating grooves for adapting the locating protrusion.

11. The printer according to claim 10, wherein the locating protrusions are formed by shaft ends of the first rotary shaft extending outside two sides of the first bracket body.

12. A printer, comprising the print head assembly according to claim 1, wherein the print head assembly is arranged on a frame.

13. The printer according to claim 12, wherein the print head assembly further comprises a transition socket arranged on the bracket and pluggably matched with an outside plug, wherein the print head is electrically connected to corresponding pins of the transition socket.

14. The printer according to claim 13, wherein the print head assembly further comprises a sensor arranged on the first bracket body for detecting printing paper, wherein the sensor is electrically connected to corresponding pins of the transition socket.

15. The printer according to claim 13, wherein the lid comprises a second bracket body and a third bracket body; the transition socket is arranged on a convert board, and the convert board is fixedly connected to the second bracket body; one end of the elastic element presses against the third bracket body, while the other end presses against the print head.

16. The printer according to claim 12, wherein the print head assembly further comprises a print head lifting mechanism, wherein the print head lifting mechanism comprises a driving element arranged inside the bracket and an adjusting element driven by the driving element; the print head is fixedly connected with a press rod pressing against the adjusting element.

* * * * *